US010106931B2

(12) United States Patent
Yu et al.

(10) Patent No.: US 10,106,931 B2
(45) Date of Patent: Oct. 23, 2018

(54) HIGH LIGHT-TRANSMITTANCE FIBER GLASS SURFACE PAPER AND PREPARATION METHOD THEREFOR

(71) Applicant: CHINA TOBACCO YUNNAN INDUSTRIAL CO. LTD, Kunming (CN)

(72) Inventors: Zhenhua Yu, Kunming (CN); Yao Yu, Kunming (CN); Ying Zhang, Kunming (CN); Jianbo Zhan, Kunming (CN); Geng Li, Kunming (CN); Jiao Xie, Kunming (CN); Han Zheng, Kunming (CN); Tingting Yu, Kunming (CN)

(73) Assignee: CHINA TOBACCO YUNNAN INDUSTRIAL CO. LTD., Kunming (CN)

( * ) Notice: Subject to any disclaimer, the term of this patent is extended or adjusted under 35 U.S.C. 154(b) by 0 days.

(21) Appl. No.: 15/310,795

(22) PCT Filed: May 12, 2015

(86) PCT No.: PCT/CN2015/078715

§ 371 (c)(1),
(2) Date: Nov. 14, 2016

(87) PCT Pub. No.: WO2016/145732

PCT Pub. Date: Sep. 22, 2016

(65) Prior Publication Data

US 2018/0051421 A1 Feb. 22, 2018

(30) Foreign Application Priority Data

Mar. 17, 2015 (CN) ..... 2015 1 0116522

(51) Int. Cl.
*D21H 27/06* (2006.01)
*D21H 19/82* (2006.01)
(Continued)

(52) U.S. Cl.
CPC ..... *D21H 27/06* (2013.01); *B05D 1/28* (2013.01); *B05D 3/067* (2013.01); *B05D 3/12* (2013.01);
(Continued)

(58) Field of Classification Search
CPC . B05D 1/28; B05D 3/067; B05D 3/12; D21H 19/824; D21H 27/06
(Continued)

(56) References Cited

U.S. PATENT DOCUMENTS 1,996,857 A * 4/1935 Davidson ..... D21H 5/08 106/164.41
2002/0108731 A1* 8/2002 Gousse ..... D21H 21/285 162/162
(Continued)

*Primary Examiner* — Thao T Tran

(57) ABSTRACT

A high-transparence fiberglass paper includes vegetable parchment which is successively coated with a base layer, a second layer and a protective layer on both sides. The base layer and protective layer are prepared using water-based paints, while the second layer is prepared using UV ink through curing. The transparency and surface smoothness of the fiber is thereby greatly improved. Through treatment on the both surfaces, the paper can be processed into a light and smooth paper, with a surface smoothness of both sides more than 200 s, just like hyaline paper.

1 Claim, 1 Drawing Sheet

(51) Int. Cl.

| | |
|---|---|
| ***B05D 1/28*** | (2006.01) |
| ***B05D 3/12*** | (2006.01) |
| ***B05D 3/06*** | (2006.01) |
| ***D21H 19/84*** | (2006.01) |
| ***D21H 27/00*** | (2006.01) |
| ***D21H 13/40*** | (2006.01) |
| ***D21H 19/20*** | (2006.01) |
| ***D21H 19/24*** | (2006.01) |

(52) U.S. Cl.
CPC ..... *D21H 13/40* (2013.01); *D21H 19/20* (2013.01); *D21H 19/24* (2013.01); *D21H 19/82* (2013.01); *D21H 19/824* (2013.01); *D21H 19/84* (2013.01); *D21H 27/00* (2013.01)

(58) Field of Classification Search
USPC ..... 427/365
See application file for complete search history.

(56) References Cited

U.S. PATENT DOCUMENTS

| | | | | |
|---|---|---|---|---|
| 2011/0060069 | A1* | 3/2011 | Arora | C09D 11/101 522/64 |
| 2013/0101809 | A1* | 4/2013 | Kohlweyer | B41M 7/00 428/195.1 |
| 2016/0325558 | A1* | 11/2016 | Strijckers | B41M 5/0047 |

* cited by examiner

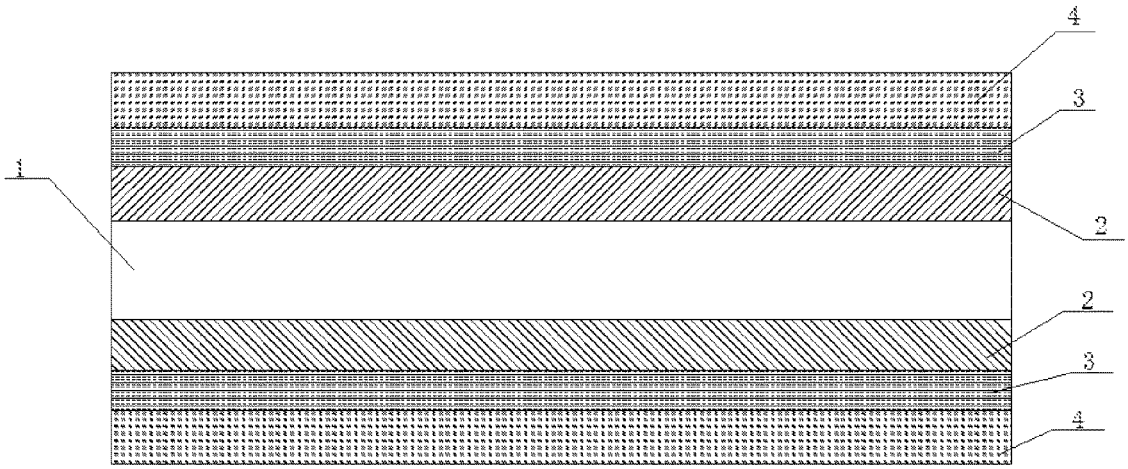
4
3
1
2
2
3
4

HIGH LIGHT-TRANSMITTANCE FIBER GLASS SURFACE PAPER AND PREPARATION METHOD THEREFOR

CROSS-REFERENCE TO RELATED APPLICATIONS

This application is a U.S. National Stage entry under the Patent Cooperation Treaty of international application no. PCT/CN2015/078715, filed 12 May 2015, which in turn claims priority of Chinese Patent Application Number 201510116522.2, filed 17 Mar. 2015. This application claims priority of both of these applications.

TECHNICAL FIELD

The invention belongs to the technical field of packing materials, specifically, a kind of high-transparence fiberglass paper with strong transparency and high surface smoothness. Meanwhile, the invention also involves a manufacturing method of the high-transparence fiberglass paper.

BACKGROUND

Vegetable parchment (also known as tracing paper) is the only kind of paper with the feature of transparency in market. It is mainly used for tracing, transfer and plate making, and limited printing. Vegetable parchment is a kind of film paper made from fine plant fibers which are interwoven with each other, soaked in 72% concentrated sulfuric acid for 2-3 s after free beating and papermaking processes in wet conditions without gluing or filling, washed with clean water, and then processed with glycerinum and dried. The vegetable parchment manufactured by this method is solid, compact and semitransparent. However, it has a rough surface and poor flatness. Smoothness is generally less than 90 s. There are drawbacks such as poor color restoration, inadaptability to fin-screen printing and insufficient definition of barcode recognition when vegetable parchment is used for package printing, which result in great limitations on its application in the printing industry; meanwhile, the loose pure fiber structure on the vegetable parchment surface also largely reduces its transparent property and limits the proper transparency of packaging products.

BRIEF DESCRIPTION OF THE DRAWING(S)

FIG. 1 shows the overall structure diagram of high-transparence fiberglass paper.

DETAILED DESCRIPTION

The invention aims to solve problems in existing technology, and provide a kind of high-transparence fiberglass paper with strong transparency and high surface smoothness used for product packaging. Meanwhile, the invention also provides the manufacturing method of the high-transparence fiberglass paper.

Unless otherwise stated, the present percentage of the specification is a quality percentage.

The purpose of the invention will be realized by the following technical schemes.

A high-transparence fiberglass paper, including a vegetable parchment is provided, wherein the vegetable parchment is successively coated with a base layer, a second layer and a protective layer on both sides; the base and protective layers are made of water-based paints, while the second layer is made of UV ink through curing. The water-based paint used by the base layer is preferentially selected from one of polyurethane solutions modified by water-based acrylic acid, while the water-based paint used by the protective layer is preferentially selected from one of the water-based acrylic acid solutions.

A surface density of the vegetable parchment is 50-150 g/m$^2$ and a thickness of the vegetable parchment is 0.05-0.12 mm.

A manufacture method of making the high-transparence fiberglass paper comprises:

(1) preparation of the vegetable parchment: select the vegetable parchment of 50-150 g/m$^2$ surface density and 0.05-0.12 mm thickness as a basal layer and for spare use.

(2) the base layer coating: adopt an anilox of 200-120 lines/inch and coat polyurethane solution modified by water-based acrylic acid onto two surfaces of the vegetable parchment with a coating density of 5-8 g/m$^2$.

(3) The second layer coating: adopt a ceramic anilox of 200-120 lines/inch and coat with UV ink of 20-50 Pa·S viscosity on the base layer with a coating density of 8-15 g/m$^2$.

(4) the second layer smoothing and embellishing: utilize a chrome plate mirror steel roller to smooth the second layer with a speed of 30-60 m/s and pressure of 1-2.5 KPA.

(5) Curing: exposure the second layer after smoothing and embellishing to an ultraviolet lamp (dedicated for UV ink) of 300-600 millijoule power for 1-3 seconds until a UV curing membrane is generated on the surfaces of the second layer; the UV lamp is a mercury lamp or LED light.

(6) the protective layer coating: adopt an anilox of 300-200 lines/inch and coat with a water-based acrylic acid solution onto two surfaces of the second layer UV curing membrane with a coating density of 3-6 g/m$^2$. Finally, the needed high transparent fiberglass paper is prepared.

Compared to existing technology, the invention has the following beneficial effects:

1. In addition to properties of the vegetable parchment of the same size, transparency and surface smoothness of the high-transparence fiberglass paper of the invention are improved significantly, and the high-transparence fiberglass paper is characterized in its light and smooth surface; through treatment on both surfaces of the vegetable parchment, the paper can be processed into light and smooth paper with surface smoothness on both sides more than 200 s, just like hyaline paper.

2. This invention is features simple processing and wide application.

Specific Implementation

Further description of this invention is provided below in accordance with the FIGURE and embodiments. The embodiments are for description and explanation of this invention only, and shall not be used to define this invention.

As shown in the FIGURE, the high-transparence fiberglass paper selects a vegetable parchment 1 with a 50-150 g/m2 surface density and 0.05-0.12 mm thickness as a basal layer. Vegetable parchment 1 shall be successively coated with a base layer 2, a second layer 3 and a protective layer 4 on both sides; the base layer 2 is made by polyurethane solutions modified by water-based acrylic acid, the protective layer 4 is made by a water-based acrylic acid solution, and the second layer 3 is made by UV ink through curing; the base layer 2 is used to connect the vegetable parchment 1 and the second layer 3.

Preparation Embodiment 1

This embodiment describes the manufacture method of high-transparence fiberglass paper, which includes the following steps:

(1) preparation of the vegetable parchment: select the vegetable parchment of 50 g/m$^2$ surface density and 0.05 mm thickness as a basal layer and for spare use;

(2) the base layer coating: adopt an anilox of 200 lines/inch and coat with a polyurethane solution modified by water-based acrylic acid onto two surfaces of the vegetable parchment with a coating density of 5 g/m$^2$;

(3) The second layer coating: adopt a ceramic anilox of 200 lines/inch and coat the UV ink of 20 Pa·S viscosity on the base layer with a coating density of 8 g/m$^2$;

(4) the second layer smoothing and embellishing: utilize a chrome plate mirror steel roller to smooth the second layer with a speed of 30 m/s and pressure of 1 KPA;

(5) Curing: expose the second layer after smoothing and embellishing to a ultraviolet lamp (dedicated for UV ink) of 300 millijoule power for 1 second until a UV curing membrane is generated on the surfaces of the second layer; wherein the UV lamp is mercury lamp;

(6) the protective layer coating: adopt an anilox of 300 lines/inch and coat water-based acrylic acid solution onto two surfaces of the UV curing membrane of the second layer with a coating density of 3 g/m$^2$. Finally, the needed high transparent fiberglass paper is prepared.

Preparation Embodiment 2

This embodiment describes the manufacturing method of high-transparence fiberglass paper, which includes the following steps:

(1) Preparation of the vegetable parchment: select the vegetable parchment of 150 g/m$^2$ surface density and 0.12 mm thickness as a basal layer and for spare use;

(2) the base layer coating: adopt an anilox of 120 lines/inch and coat with a polyurethane solution modified by water-based acrylic acid onto two surfaces of the vegetable parchment with a coating density of 8 g/m$^2$;

(3) the second layer coating: adopt a ceramic anilox of 120 lines/inch and coat the UV ink of 50 Pa·S viscosity on the base layer with a coating density of 15 g/m$^2$;

(4) the second layer smoothing and embellishing: utilize a chrome plate mirror steel roller to smooth the second layer with speed of 60 m/s and pressure of 2.5 KPA;

(5) curing: expose the second layer after smoothing and embellishing to the ultraviolet lamp (dedicated for UV ink) of 600 millijoule power for 1-3 seconds until a UV curing membrane is generated on the surface of the second layer; wherein the UV lamp is a LED light;

(6) the protective layer coating: adopt an anilox of 200 lines/inch and coat water-based acrylic acid solution onto two surfaces of the UV curing membrane of the second layer with a coating density of 6 g/m$^2$. Finally, the needed high transparent fiberglass paper is prepared.

Preparation Embodiment 3

This embodiment describes the manufacture method of high-transparence fiberglass paper, which includes the following steps:

(1) preparation of the vegetable parchment: select the vegetable parchment of 100 g/m$^2$ surface density and 0.08 mm thickness as a basal layer and for spare use;

(2) the base layer coating: adopt an anilox of 160 lines/inch and coat polyurethane solution modified by water-based acrylic acid onto two surfaces of the vegetable parchment with a coating density of 6.5 g/m$^2$;

(3) the second layer coating: adopt a ceramic anilox of 150 lines/inch and coat the UV ink of 35 Pa·S viscosity on the base layer with a coating density of 10 g/m$^2$;

(4) the second layer smoothing and embellishing: utilize a chrome plate mirror steel roller to smooth the second layer with speed of 45 m/s and pressure of 1.8 KPA;

(5) curing: expose the second layer after smoothing and embellishing to the ultraviolet lamp (dedicated for UV ink) of 480 millijoule power for 2 seconds until a UV curing membrane is generated on the surface of the second layer; wherein the UV lamp is the LED light;

(6) The protective layer coating: adopt an anilox of 250 lines/inch and coat water-based acrylic acid solution onto two surfaces of the second layer UV curing membrane with a coating density of 5 g/m$^2$. Finally, the needed high transparent fiberglass paper is prepared.

During the practical production process, required high-transparence fiberglass paper can be manufactured by adjusting the Preparation Embodiment 1-3 and then roll up and segment according to specifications.

The above-mentioned embodiments are preferred embodiments of this invention, which do not restrict the invention. Though detailed explanation has been made by referring to the above-mentioned embodiments, professional technicians could still change those technical proposals established in the above-mentioned embodiments or replace some technical features. Any modification, change, improvement within the concept and principle of this invention shall be included in the protection scope of this invention.

The invention claimed is:

1. A method for manufacturing high-transparence fiberglass paper comprising:

selecting as a base layer a vegetable parchment having a surface density in a range of 50-150 g/m$^2$ and a thickness in a range of 0.05-0.12 mm;

using a first anilox having a lines/inch characteristic in a range of 200-120 lines/inch, coating both sides of the base layer with a water-based paint with a density in a range of 5-8 g/m$^2$, said water-based paint being a polyurethane emulsion modified by water-based acrylic acid;

using the first anilox, applying a second coating layer on both sides of the base layer, said second coating layer comprising UV ink having a viscosity in a range of 20-50 Pa·S and a coating density in a range of 8-15 g/m$^2$; and using a chrome plate mirror steel roller, smoothing the second coating layer at a speed in a range of 30-60 m/s and with a pressure of 1.0-2.5 KPA;

curing the second coating layer by exposing it to a UV ink-specific ultraviolet lamp having a power in a range of 300-600 millijoule for a curing period in a range of 1-3 seconds, thereby forming a UV curing membrane on the second coating layer; and using a second anilox having a lines/inch characteristic in a range of 300-200 lines/inch, applying, to both surfaces of the cured second coating layer, a protective layer comprising water-based paint with a coating density in a range of 3-6 g/m$^2$, said water-based paint comprising a water-based acrylic acid emulsion.

* * * * *